US006145549A

United States Patent [19]

Euerle et al.

[11] Patent Number: 6,145,549

[45] Date of Patent: Nov. 14, 2000

[54] APPARATUS FOR THE PRODUCTION OF RIGID BIAXIAL FABRIC MATERIAL

[75] Inventors: Keith Bryan Euerle, Fairless Hills; Frank Joseph O'Neill, Horsham, both of Pa.

[73] Assignee: Fabric Development, Inc., Quakertown, Pa.

[21] Appl. No.: 09/030,678

[22] Filed: Feb. 26, 1998

[51] Int. Cl.[7] ..... D03C 9/02

[52] U.S. Cl. ..... 139/93

[58] Field of Search ..... 139/93, 94

[56] References Cited

U.S. PATENT DOCUMENTS

| | | | |
|---|---|---|---|
| 1,930,151 | 10/1933 | Smith | 139/93 |
| 3,985,160 | 10/1976 | Kulczycki et al. | 139/93 |
| 5,699,836 | 12/1997 | Golz | 139/93 |
| 5,758,696 | 6/1998 | Nishikawa | 139/93 |

*Primary Examiner*—Andy Falik

[57] ABSTRACT

A heddle having a canted parallelogram shaped eye to facilitate the feeding of a fiber strip and improve the process of forming rigid biaxial fabric materials by a weaving machine.

7 Claims, 4 Drawing Sheets

APPARATUS FOR THE PRODUCTION OF RIGID BIAXIAL FABRIC MATERIAL

BACKGROUND OF THE INVENTION

1. Field of the Invention

This invention relates to a method and apparatus for the production of a biaxial woven fabrics.

2. Description of the Prior Art

The use of high performance woven materials is becoming increasingly common in applications such as aerospace and aircraft structural components. Particularly for use as reinforcing structures in forming rocket motor parts, heat resistant components as well as primary and secondary load bearing members it has become the material of choice. To provide the physical properties necessary to function in these demanding environments, these fabrics must be manufactured to great accuracy so that there is as much uniformity as is possible. A non-uniform woven fabric would create localized stress areas that would increase the possibility of a part failure. Misalignment of the warp or weft components cannot be tolerated in these applications. The fabric must be flat and uniform in appearance with no dense areas or voids. Generally, these high performance fabrics are manufactured from relatively flexible materials where mildly modified textile tooling does not produce a satisfactory product. In the normal weaving process, machines produce fabric from raw material (yarn, thread, etc. . . .). This raw material is generally made up of multiple strands of fiber that is bound in some way to create a rope-like consistency. The fiber is free to move in any direction desired, and in many cases the fiber can conform to any configuration. With this being the case, the weaving process is often very forgiving.

In a biaxial tape fabric, however, the materials used to form these fabrics are of a rigidized variety that have two fiber systems coming together to form the eventual woven fabric. The two fiber systems include warp fibers (0°) and filling fibers (90°). Woven fabric is a planar structure consisting of the warp and filling fiber which interlace at right angles. The mechanical weaving of biaxial tape material becomes increasingly difficult do to its radical differences from normal weaving materials. The major difference being the pre-processing that the raw material has undergone. Multiple strands of fiber are processed by impregnating the fibers with a resin to form a thin sheet of rigid material, followed by a slitting process to form a hard ribbon like tape. This strip is flexible in only one direction (up and down) and side-to-side movement is not possible while maintaining the flatness of the strip. Although the strip can be bent along its length quite easily, bends of less than ⅜ inch radius can result in fractures of the fibers thus making the normal weaving process impractical. This strip also lacks any elasticity, and is therefore unforgiving in the weaving process.

The basic weaving process that results in this interlacing is begun by first separating the flat sheet of warp fibers into two separate layers to form a "V" shaped opening which is called the shed. This "shed" is formed by raising and lowering of the harness frames which house the heddles that control the individual warp ends. Once the "shed" is formed, it becomes time to insert the filling fiber (90°). The task of inserting the filling fiber is accomplished by the presentation of a long slender object with a clamping tip which is known as a rapier into and through the "shed" opening. When the rapier is fully through the "shed" opening, the filling fiber is presented and attached to the rapier tip so that the rapier can insert the filling fiber into the "shed" by pulling it through during its return trip to the beginning of its cycle. Conventional looms are designed to handle textile fibers which are very flexible and these flexible textile fibers can be presented to the rapier tip in a variety of out of plane configurations. However, with rigid strips, the filling strip (90°) must be presented to the rapier tip in a flat plane. Conventional looms, at this point, would damage and deform the rigid filling strip, thus producing an unacceptable fabric. Furthermore, production breakdowns and overall less efficient production rates, with conventional equipment leads to a less economically efficient method, are more operator intensive and produce off-specification material.

Acceptable material requires that there be zero airspace between each individual fiber strip without creating physical damage to the material. Therefore, rigid flat fiber strips must be placed with precision into their respective orientation in a flat and uniform manner.

Therefore, there exists a need to provide a method and an apparatus for the efficient and economical production of rigid biaxial woven fabrics.

SUMMARY OF THE INVENTION

In accordance with this invention, the aforementioned problems are overcome by a method and an apparatus for the production of rigid biaxial woven fabrics by the provisions of a novel heddle system and a filling feeder device. More particularly, the weaving apparatus for introducing at least one filling fiber into a sheet of warp fibers so as to assist in holding the sheet together comprises:

- means for moving a sheet of warp fibers longitudinally through a plurality of heddles each heddle having a canted parallelogram shaped eye so that a substantially flat fiber strip may pass through at a predisposed angle;
- a plurality of support elements;
- a plurality of guide means; each of said heddles being housed within a corresponding support element and vertically moving with the corresponding guide means to achieve a shed according to the position of the heddle;
- drive means for vertically drawing each of said heddles in a particular grouping;
- means for reciprocating a rapier transversely across the warp sheet at said opening;
- means for introducing a substantially flat filling fiber into the rapier; said means includes a feeding means, a clamping means and a cutting means;
- the feeding means advances the substantially flat filling fiber to the rapier at the end of the rapier stroke;
- cutting means for cutting the filling fiber introduced under predetermined warp fibers and over the remaining warp fibers at the end of each complete reciprocation of the rapier;
- clamping means for clamping and holding the remaining filling fiber supply after the cutting has taken place; and
- means for packing the fiber to provide the uniformity and density necessary to produce a tightly-packed, rigid flat woven fabric.

A method of introducing at least one filling rigid fiber into a sheet of warp rigid fibers so as to assist in holding the sheet together, according to this invention comprising the steps of:

- moving the sheet of warp fibers through a plurality in a substantially flat plane;
- passing said warp fibers through a plurality of heddles wherein each heddle having a parallelogram shaped eye so that the substantially flat fibers may be canted to a predetermined angle;

reciprocating at least one rapier transversely across the warp sheet at the shed; presenting and securing a filling fiber to the rapier;

introducing the filling fiber on the reciprocating stroke under the predetermined warp fibers and over the remaining warp fibers;

severing the filling fiber at the completion of reciprocation cycle at the point of introduction; packing the filling fiber to improve the uniformity and density to yield a highly packed flat woven fabric; and recovering said flat tightly woven fabric.

Another embodiment of the present invention includes a heddle comprising: an elongated member having canted parallelogramed shaped eye positioned on its longitudinal centerline; and having top and bottom mounting holes.

Another embodiment is a device for controlling the feed and length of a filling strip during a weaving process comprising a housing containing a guide track for introducing the filling strip into said filling feeder device, a first pneumatic cylinder controlling an idler roller, a motor driven roller which in cooperation with said idler roller operates to move said filling strip through said feeder device, a clamping means and a cutting means, a second pneumatic cylinder for controlling said clamping means and said cutting means and a rapier port for receiving a rapier and securing said filling strip to said rapier.

Still another embodiment of the invention is directed to a biaxial carbon fabric by the claimed method.

It is therefore one primary object of this invention to provide an apparatus for the production of biaxial woven fabrics.

Yet another object of this invention is to provide an improved heddle for a weaving machine for making rigid biaxial fabrics, which heddle is adapted to be readily manipulated by automatic means for effecting the shed forming operations thereof.

Still another object of this invention to provide a filling feeder which insures a flat orientation of the filling fiber, the filling feeder device comprises a drive roller system and a clamping/cutter mechanism.

Other and further objects of this invention will be apparent from the drawings and the following detailed description thereof which is set forth for the purpose of explaining the invention and is not regarded as necessarily limiting the scope of the invention which is defined in the appended claims.

BRIEF DESCRIPTION OF THE DRAWINGS

The above and other objects and advantages and novel features of the present invention will become apparent from the following detailed description of the preferred embodiments of the invention illustrated in the accompanying drawings. Similar reference numerals refer to similar parts throughout several views of the drawings where.

DETAILED DESCRIPTION OF THE PREFERRED EMBODIMENTS

Figure 1:
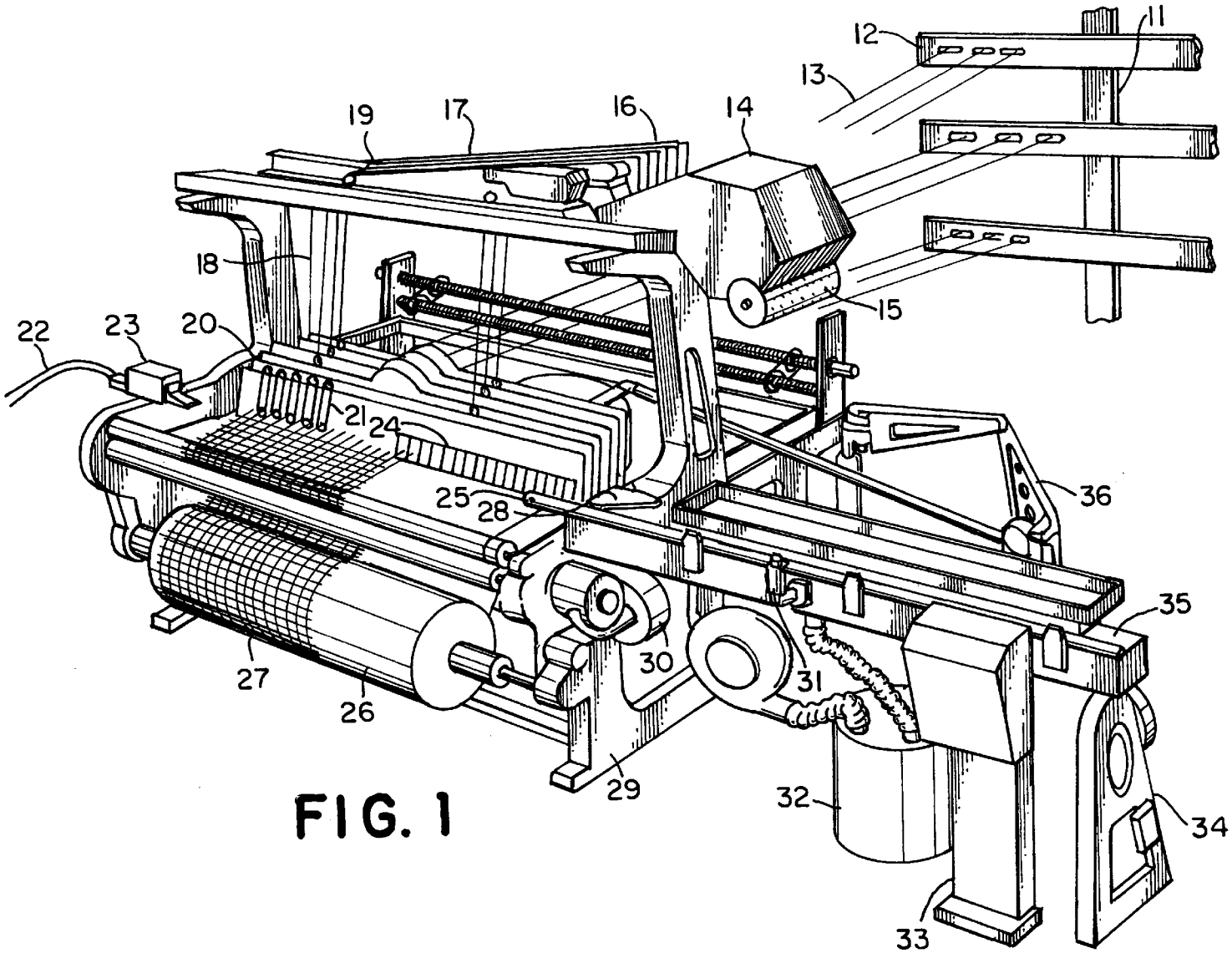
FIG. 1 is a perspective view of the preferred rigid rapier loom with modifications for biaxial rigid fabric production.
Figure 2:
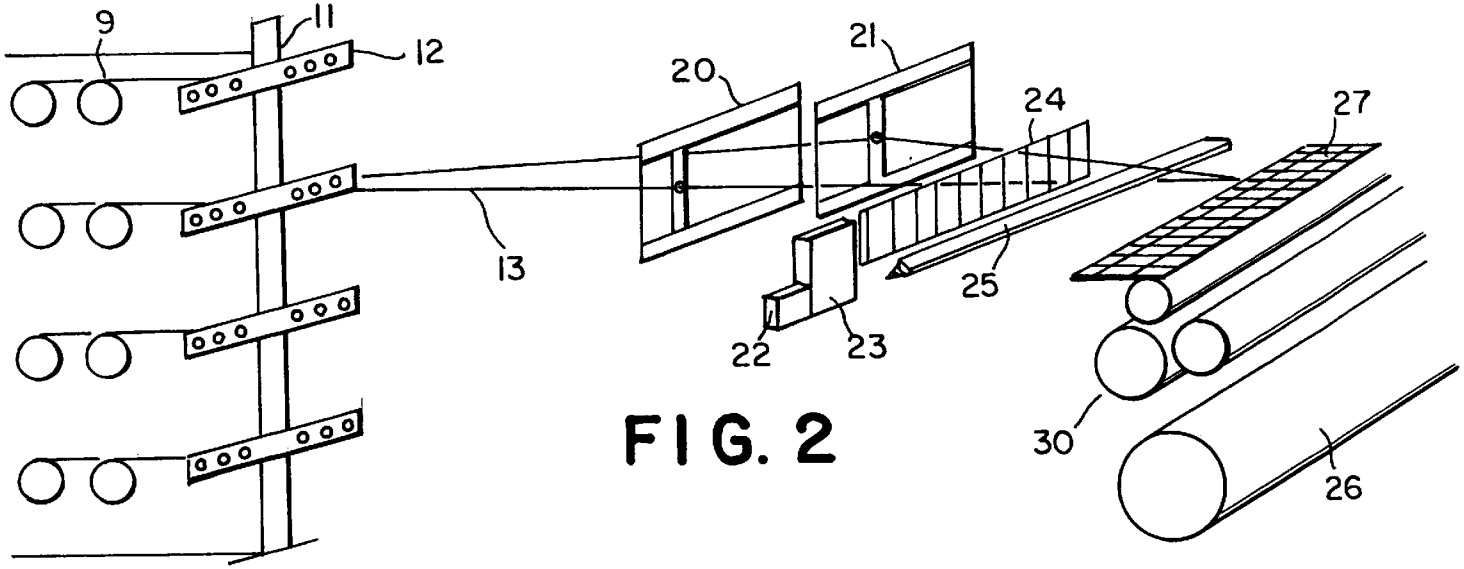
FIG. 2 is another perspective view of the preferred rigid rapier loom showing the schematic of the shed forming section.

Various aspects of the invention are described in relation to FIGS. 1 through 5 wherein like numbered components are equivalent. Referring specifically to FIG. 1, a weaving apparatus such as a rigid rapier loom 10 which is modified according to this invention is shown. The apparatus 10 is particularly suitable for forming a rigid biaxial tape material where the warp fibers components side-by-side in the 0° direction and the filling fibers are side-by-side in the 90° direction. Preferably, the bi-directional woven fabric is produced according to this invention from intermediate modulus unidirectional carbon fibers that are reinforced with amorphous thermoplastic resin. The unidirectional carbon fiber used as a starting material in this method is first cut into 0.25 inch wide strips from a 12 inch wide master web and would onto spools 9 (FIG. 2). The creel 12 carries a number of these spools 9 of rigid unidirectional carbon flat strips or other continuous carboniferous fibers. A flat strip 13 is withdrawn from each of these spools 9 and passes through a respective creel eyeboard 11. The flat strips 13 which emerge longitudinally from the creel eyeboards 11 are then tensioned by the dynamic warp tension system 17 to form homogenous flat sheets of warp fiber strips 13 that correspond to particular eyeboards. The flat sheet 13 is separated into distinct layers to form a "V" shaped opening. This warp shed forming operation occurs by passing the flat fiber strips 13 through heddles 21 and then by a predetermined program raising and lowering the harness frames 20 which house and support the heddles 21. For the purpose of this disclosure only, a few heddles 21 are shown in FIG. 1. The predetermined program is controlled by a pattern card 15. The heddles 21 have the unique canted parallelogram shaped eye (FIGS. 3A and 4A) which is necessary to position each of the rigid flat strips 13 at a predetermined angle. Preferably this angle allows the passage of the 0.25 inch strip through each heddle 21 and prevents any side-to-side movement of the strip. This prevents the strips from becoming entangled and damaged beyond acceptance and the finished tape product would not meet specifications in fiber count and areal weight.

Almost simultaneously at the shed formation, a rapier 25 having a clamping tip 55 is thrust through toward the novel filling feeder 23. The feeder 23 performs three function of loading, clamping and cutting the filling fiber 22. The filling feeder device 23 will be discussed in more detail later in the disclosure. After loading and securing the filling fiber 22 to the rapier tip 55, the rapier 25 is pulled back transversely through the shed along with the filling fiber 22 to the rapier starting point. At this point, across the other end the filling feeder device 23 cuts the filling fiber. The reciprocating movement of the rapier is repeated as required in concert with the shed openings.

The next operation on the loom 10 involves the forward movement of the reed 24 which is a comb-like apparatus which pushes the latest filling fiber 22 against the filling fiber 22 just previously inserted. When this operation is complete the shed opening is closed, the fabric continues to move longitudinally and a different set of harness frames 20 is lifted and lowered in accordance with the preprogrammed pattern card 15.

After the warp fiber 13, which has had the filling or weft fiber 22 so introduced to form the rigid biaxial fabric or tape 27 it passes to take up roll 26.

Figure 5:
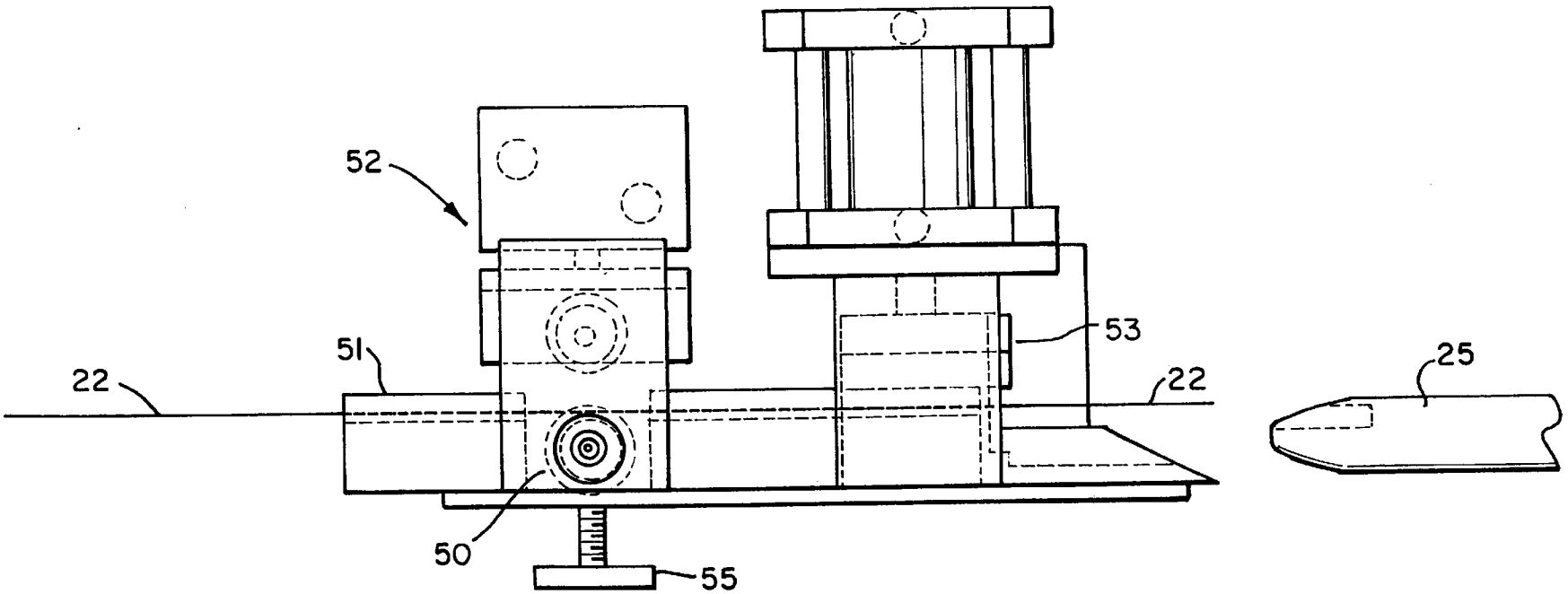
FIG. 5 is a side elevation view of the improved filling feeder according to this invention.

Referring to FIG. 2 along with FIG. 5, a more detailed discussion of the weaving process for producing a biaxial fabric in accordance with the present invention follows. FIG. 2 is a schematic perspective view of the weaving process including the shed forming operation. At the beginning of the weaving cycle, (after the warp fiber 13 reaches the heddles 21 in the harness frame from the warp supply spools 9, through the creels 11 and creel eyeboards 12) the reed 24 is in the back position, one harness is up and four harnesses are down with the shed formed and opened.

The weaving method in accordance with this invention comprises the steps of:

Step #1

The rapier 25 moves through the shed travelling from its starting position heading towards the biaxial filling feeder device 23. The rapier tip 55 will interface with the rapier port 58 of the biaxial tape filling feeder device 23 at the end of the rapier stroke the rapier tip 55 is fully engaged with the rapier port 58 of the feeder. At the end of this rapier stroke, a switch is tripped signaling the programmable logic controller 15 to do the following: 1) release the clamping/cutter mechanism 53 while engaging the feed roller 50 and 2) engage pneumatic rapier cam 28.

Step #2

As a result, the filling fiber 22 is fed through the filling feeder device 23 by the motor driven feed/roller 50 (FIG. 5) into the tip of the rapier 55. The engagement of the rapier cam 28 opens the clamping mechanism (not shown) housed inside the rapier tip 55 that holds the filling fiber 22 once it is fully inserted into the rapier tip 55. As the filling fiber 22 is fully inserted into the rapier tip 55 by the feed roller 50, the rapier cam disengages, which closes the internal rapier tip clamping mechanism to ensure a positive connection between the filling fiber 22 and the rapier 25. The feed roller 50 will continue to overfeed the filling fiber 22 into the rapier tip 55 for a few seconds after the closing of the clamping mechanism to ensure that the fiber is not pulled free from the rapier tip 55 as a result of initial filling tension. After this overfeeding the feed roller 50 disengages, leaving the fiber path of the filling feeder device 23 open to allow uninhibited passage of the filling fiber 22 through the feeder device 23.

Step #3

Now that the filling fiber 22 has been secured by the rapier tip 55, the rapier 25 itself begins to move back through the shed pulling the filling fiber 22 behind it. At this point, the fiber path through the filling feeder 23 remains opened to allow the rapier 25 to pull the filling fiber 22 through the shed. As the rapier 25 nears the end of its return stroke the harness that had been lifted now begins to drop closing the shed opening. This shed closing helps in flattening the filling fiber 22 into the proper plane.

Step #4

Once the rapier clears the shed a stationary cam is used to disengage the rapier tip 55 clamping mechanism thereby releasing the filling fiber 22 from the rapier 25 while essentially at the same time the clamping/cutting mechanism 63 of the filling feeder 23 engages. Thereby locking the remaining filling supply in the required position while the cutting completes a single pick insertion.

Step #5

After the completion of the pick insertion the reed 24 moves forward to essentially push the pick into its final resting place as part of the woven fabric. This motion of pick placement is known as "beat-up" and this is where fiber becomes woven fabric. Once "beat-up" has taken place the reed 24 moves to its back and original position. During the process of the reed moving back the take-up system 30 and cloth take-up 26 will advance to allow room for the placement of the next pick. The process of Step #1 through Step #5 is then repeated using different harness lifting variations in order to achieve the desired pattern effect.

Accordingly the apparatus and the method of this invention employing an intermediate modulus continuous, unidirectional carbon fiber reinforced with amorphous thermoplastic resin provides a biaxial tape without any air space between the fiber strips, having no twist or convolutions, in flat and uniform in appearance without high spots or voids. This material is suitable for use in aircraft structural applications.

According to another aspect of the invention, a novel heddle 21 is disclosed. Referring to the drawings FIGS. 3A, 3B, 4A and 4B the unique and novel heddle is particularly devised for use with a loom for weaving of a type having flat rigid fiber strips side-by-side in both the warp (0°) direction as well as the filling (90°) direction.

Figure 3A:
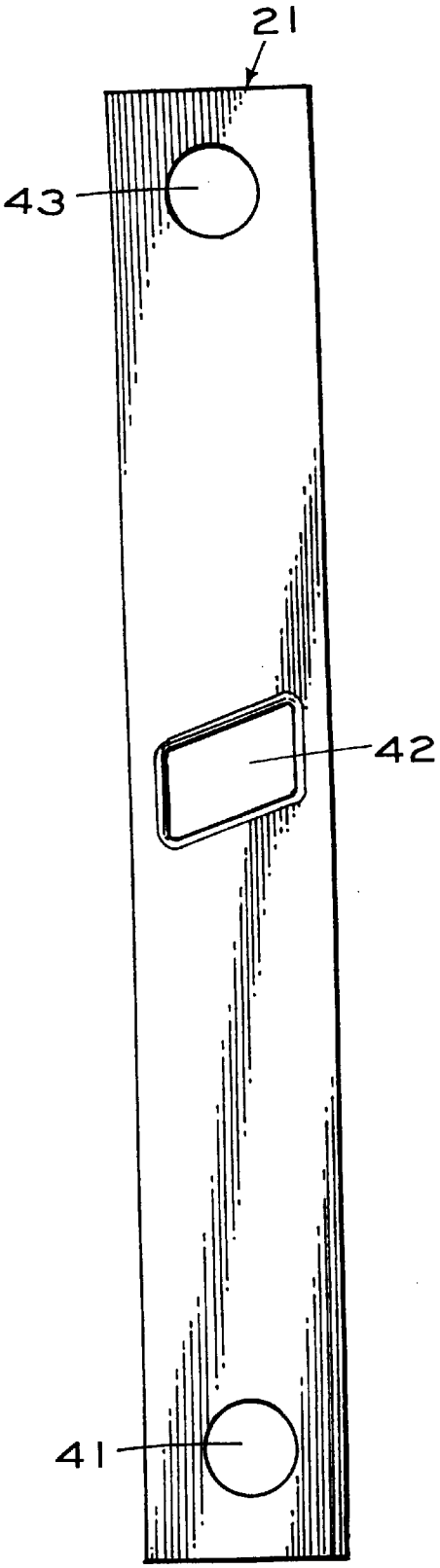
FIG. 3A shows the front view of the heddle according to the invention.
Figure 3B:
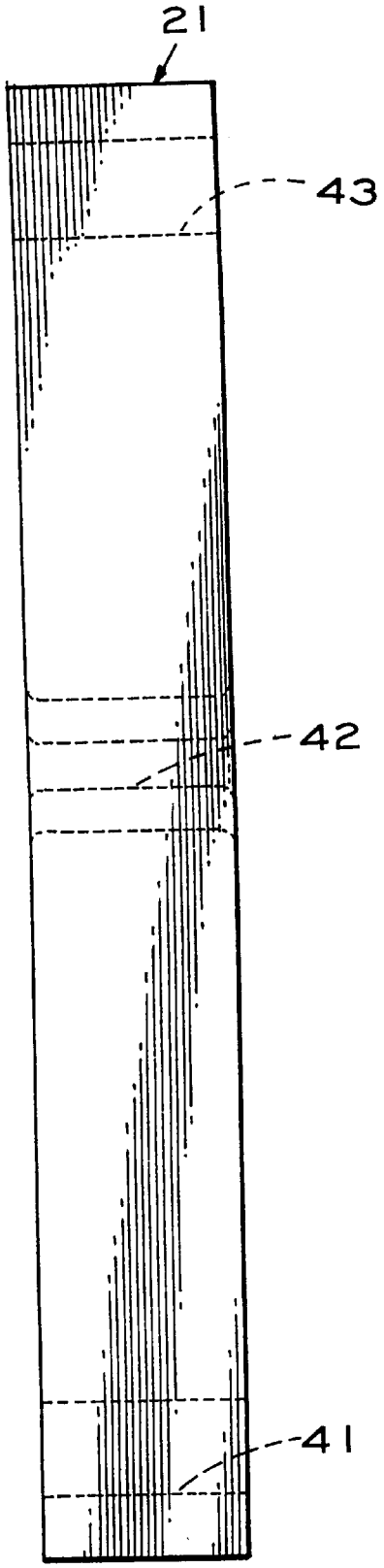
FIG. 3B shows the side view of the heddle of FIG. 3A.

With reference to FIGS. 3A and 3B, the heddle 21 is shown as a flat and thin elongate having a heddle eye 42 in the shape of a parallelogram canted at a predetermined angle and positioned on the longitudinal centerline and midway between the top and bottom of the heddle. Preferably, two mounting holes 41 and 43 are provided and positioned along the longitudinal centerline and are preferably in direct alignment with each other. The heddles 21 are secured in the harness frames 20 in a manner wherein the top and bottom of the heddle are normal to the frame 20 by the usual mechanical means and need only be in sufficient alignment to impart relative uniformity in the desired angle to the warp strips 13.

In one preferred embodiment, the heddle is manufactured from a 0.25" square piece of mild steel 14" long, whereas two mounting holes are provided equidistant from both ends, one being 0.1875" center of hole to the top of the heddle and the other being 0.1875" center of hole to end of the heddle. Holes are typically 0.144" in diameter.

Centered midway between both ends and centered between the sides is the heddle eye which is in the shape of a canted parallelogram. The angle of the eye is presented in FIGS. 3A, 3B, 4A and 4B and ranges from about 29.5° to about 33.5° and preferably about 31.7° relative to the base of the heddle.

In another preferred embodiment, the heddle is a solid rectangle having five apertures (not shown). The top and bottom two apertures are mounting holes having a diameter of approximately 0.144 inches and located 0.200 inches and 0.500 inches from the center to the top and bottom of the heddle. Preferably, the heddles are secured in a manner which prevents side-to-side movement of the warp fiber to insure the proper density in the final product i.e. zero spacing between the strips.

Figure 4B:
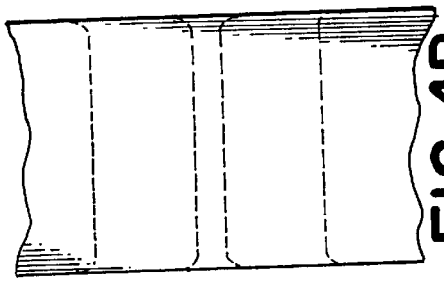
FIG. 4B illustrates a partial close-up view of FIG. 3B.
Figure 4A:
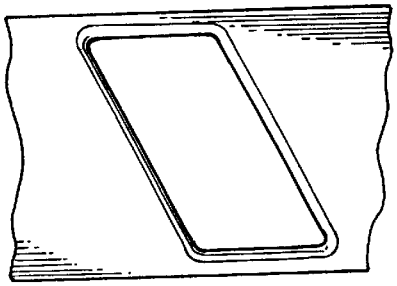
FIG. 4A shows detailing partly in section of FIG. 3A.

The heddle eye 42 is shown in more detail in FIGS. 4A and 4B. The parallelogram shape of the eye facilitates the means by which all warp strips can be controlled while maintaining the proper finished fabric width. The quarter-inch heddle cannot have a quarter inch hole, therefore the eye is angled to accept the quarter inch strips. There is a limit to the angle and the factors are determined by stress on the canted strip edge and the strips ability to return to a flat state. In addition, the leading and trailing edge of the eye opening is relieved to provide a smooth transition of the strip through the eye. The corner of the eye opening are provided with a radius of 0.024" which protects the edges of the strip from fraying as it passes through the eye. The parallelogram configured eye generally measures 0.255×0.100 inches and is disposed at an angle of 31.70 degrees relative to the bottom of the heddle 42. Preferably, the heddles 21 are manufactured from mild steel and are coated with either a chromium electrolyzed coating or a nickel-chrome plating.

Still another embodiment of this invention includes the novel filling feeder device 23. As shown in FIG. 5, the filling feeder is the device that controls the filling strip during the weaving process, feeding the strip into the rapier tip 55 to enable the rapier 21 to draw the strip through the warp, then cutting the filling strip when the weaving process is complete. The filling feeder device 23 is comprised of two basic components:

1. a motor driven feed roller 50 along with an idler roller 56 to move the filling strip 22 through the device; and
2. a clamping mechanism 63 that includes a cutting means which can be activated separately.

The drive roller 50 and the idler roller 56 are made of rubber or rubberized wheels. Typically, the drive roller 50 is powered by an electric motor and is adjusted by tensioning screw 57. However, pneumatic or hydraulic drives may also be employed.

In operation, the filling strip 22 is fed by hand through the guide track 51 of the feeder device 23. The weaving machine 10 is then switched to the automatic mode thus causing the filling feeder device 23 to operate. The pneumatic clamping/cutting mechanism 63 is activated by the use of pneumatic means subjected to commands from the programmable controller 15. Such pneumatic means include air pressure which is fed through inlet 62 to air cylinder 60 which forces the clamping/cutting mechanism 63 to drive the clamping mechanism to hold the filling strip 22 firmly in the unit, at the same time shearing any excess filling strip 22 that may be protruding beyond the filling feeder 23. At this point, the weaving process begins. The first harness 20 lifts as the rapier 21 begins its travel through the shed toward the filling feeder 23. When it reaches the feeder device 23, a switch indicates to the programmable controller 15 that the rapier tip 55 is in the open position to receive the filling strip 22. At this time, the rapier tip 55 is in the open position. The rapier 21 continues into the docking port 57 of the feeder 23 thus precisely aligning the rapier tip 55 to the feeder device 23. Then air pressure is released through outlet 61, the clamp mechanism 63 releases and frees the filling strip 22. Simultaneously, the idler roller 56 housed in air cylinder 52 forces by pneumatic means, i.e., air pressure provided through inlet 54 under programmed commands, the filling strip 22 onto the drive roller. The motor drive (not shown) starts rotating the drive roller 50, forcing the strip 22 through the feeder and into the rapier tip 55. As the rapier 25 starts its return trip, the tip 55 is closed by retraction of the pneumatic cam 28. At the same time the idler roller 56 is disengaged by releasing air pressure through outlet 53 allowing the rapier 25 to then pull the strip 22 through the feeder device 23. When the rapier 25 has completed its return a switch is made and the clamping mechanism 63 is activated pneumatically again firmly holding the strip while the cutting mechanism shears it off. Concurrently, the programmed selected harness is moving down and another is coming up thus starting another cycle. Without this feeder mechanism, it would be impossible to properly place the fiber strip in the filling (0° direction).

Finally, applicants wish to note that many different materials may be useful for weaving the multi-axial, two dimensional fabric according to the present invention. These materials include, any type of fiber composition providing that it can be put into a rigidized tape format. These materials include fibers selected from carbon, ceramics, metal and mixtures thereof. These representative fibrous materials may be used in strip form.

It will be understood that various details of the invention may be changed without departing from the scope of the invention. Furthermore, the foregoing description is for the purpose of illustration only, and not for the purpose of limitation—the invention being defined by the claims.

KEY FOR MODIFIED RAPIER LOOM IN FIG. 1

10. Weaving Apparatus
11. Creel Structure
12. Creel Eyeboards
13. Warp Fiber or Strip
14. Dobby Head
15. Pattern Logic Controller
16. Lifting Jacks
17. Dynamic Warp Tension System
18. Harness Cords
19. Dynamic Warp Tension System
20. Harness Frames
21. Heddles
22. Filling Fiber or Strip
23. Filling Feeder Device
24. Reed
25. Rapier
26. Take-up Roll
27. Finished Woven Fabric
28. Pneumatic Rapier Cam
29. Loom Frame
30. Take-up Roller Mechanism
31. Oil Reservoir
32. Vacuum System
33. Electrical Supply Box
34. Oil Overflow
35. Cursor Shaft
36. Rapier Connecting Arm

What is claimed is:

1. A heddle for controlling the movement of a yarn, said heddle comprised of:

an element having a heddle eye in the shape of a parallelogram canted at a predetermined angle and positioned on the longitudinal centerline and at a midpoint between the top and bottom of said element; and securing means for attaching said element to a handle frame.

2. The heddle according to claim 1 wherein said heddle is formed from 0.25 inch steel bar stock.

3. The heddle according to claim 2 wherein said steel bar is coated by means of a chromium electrolyzing or nickel chrome process.

4. The heddle according to claim 1 wherein the perimeter of said parallelogram is milled to a smooth surface.

5. The heddle according to claim 1 wherein said securing means include at least one top aperture and at least one bottom aperture, each said aperture being configured to accommodate mechanical securing means to said heddle frame.

6. A heddle for controlling the movement of a fiber, said heddle comprised of:

an elongated member having a heddle eye positioned on longitudinal centerline of said heddle and centered midpoint between the top and the bottom of said member for insertion of a rigid flat warp strip;

said heddle eye being in the shape of a parallelogram having the dimensions of about 0.255 inches by 0.100 inches and having an angle from about 29.5° to about 33.5° from the base; and at least one top mounting hole and at least one lower mounting hole, said mounting holes being located respectively 0.200 and 0.500 inches from the top and bottom of said heddle.

7. The heddle of claim 6 wherein the parallelogram is at an angle of 31.7° from the base.

* * * * *